United States Patent [19]

Taketomi

[11] 4,036,543

[45] July 19, 1977

[54] PLUG RECEPTACLE HAVING A ROTATABLE RECEPTACLE MEMBER

[76] Inventor: Bunsaku Taketomi, 56-141 aza-Ishikane, oaza-Iwasaki, Nisshin-cho, Aichi, Aichi, Japan

[21] Appl. No.: 735,914

[22] Filed: Oct. 27, 1976

[30] Foreign Application Priority Data

| | | |
|---|---|---|
| Oct. 27, 1975 | Japan | 50-146691[U] |
| Nov. 29, 1975 | Japan | 50-162554[U] |
| July 12, 1976 | Japan | 51-92616[U] |

[51] Int. Cl.[2] ..... H01R 39/00

[52] U.S. Cl. ..... 339/2 R; 339/8 P

[58] Field of Search ..... 339/2 R, 2 L, 2 RL, 339/8 R, 8 P, 154 A, 155 T, 156 T, 166 T

[56] References Cited

U.S. PATENT DOCUMENTS

| | | | |
|---|---|---|---|
| 2,898,572 | 8/1959 | Shinn | 339/8 P |
| 3,629,784 | 12/1971 | Bjorn | 339/8 P |

*Primary Examiner*—Roy Lake
*Assistant Examiner*—DeWalden W. Jones
*Attorney, Agent, or Firm*—William A. Drucker

[57] ABSTRACT

The disclosure is directed to a plug receptacle including a ball member having a spherical outer peripheral surface. The ball member is rotatably supported on a bearing surface formed at an open end of a socket member. A connecting member maintains the ball member in contact with the socket member when the device is in normal use. The ball member has openings adapted to receive contact pins of a plug. The ball member is rotatable in any direction with the movement of the plug received in the openings.

12 Claims, 9 Drawing Figures

PLUG RECEPTACLE HAVING A ROTATABLE RECEPTACLE MEMBER

This invention relates to a plug socket or receptacle for receiving a plug attached to an electric appliance. More particularly, this invention is concerned with a plug receptacle including a rotatable member having openings for insertion of contact pins or poles of a plug and adapted for rotation in a direction which permits the plug pins to be pulled out of the member in a direction parallel to the longitudinal axes of the openings.

There is known a plug receptacle having such a rotatable ball member. This plug receptacle is advantageous in that the plug can be pulled in any of a certain range of directions for detachment from the receptacle, since the plug pin openings turn to face the same direction. The device, however, comprises a socket member adapted to be stationarily supported on a wall of a room or the like and a ball member enclosed in the socket member. Complicated means are required to hold the ball member rotatably in the socket member. The ball member cannot easily be separated from the socket member, because the greater portion of the ball member is enclosed within the socket member. The plug receptacle of such construction disadvantageously requires a great expenditure of time and labor for internal inspection in case of electrical feature therein. This device is further disadvantageous because it requires complicated means for establishing adequate electrical connection between the ball and socket members, while maintaining the necessary rotatability of the ball member relative to the socket member.

It is, threfore, an object of this invention to provide a novel and improved plug receptacle having a rotatable member which does not have any of the aforementioned drawbacks. The plug receptacle of this invention comprises a socket member, a generally spherical ball member and a member connecting the ball member to the socket member. The socket member is open at one end and has a flared annular bearing surface encircling the open end. The ball member has an outer peripheral surface which is spherical and complementary to the bearing surface of the socket member. The connecting member maintains the outer peripheral surface of the ball member in slidable contact with the bearing surface of the socket member. The ball member includes a flat surface in which openings are formed for receiving contact pins or poles of a plug. The ball member is rotatably supported on the bearing surface of the socket member, so that its plug pin receiving openings can have their longitudinal axes turned in any of a certain range of directions so as to face upward or downward, leftward or rightward, or otherwise within a predetermined angle relative to the socket member. For detachment of the plug from the device of this invention, therefore, one can pull a plug cord in any of a certain range of directions that is convenient to him. In whichever of such directions the cord may be pulled, adequate angular movement of the ball member takes place immediately relative to the socket member to permit the contact pins of the plug to be easily pulled out in a direction parallel to the longitudinal axes of the plug receiving openings in the ball member.

The socket member is very simple in construction and easy to manufacture. The socket member may comprise a hollow cylindrical body which is open at one end and closed at another end, and which is formed with a flared annular bearing surface at its open end. The bearing surface has a spherical configuration in a planewhich is parallel to the longitudinal axis of the socket member, and is complementary to the outer peripheral surface of the ball member. The ball member may, thus, be readily positioned in place relative to the socket member with its outer peripheral surface held against the bearing surface of the socket member. Accordingly, the plug receptacle of this invention is very easy to assemble.

The connecting member may comprise a string of a sufficient length. This string may advantageously be of such length as to permit, without its detachment from the socket and ball members, separation of the ball member from the socket member by a distance. which is sufficient to provide easy access to the interior of the device. Accordingly, the device of this invention is very easy to inspect and repair in case any problem is encountered with internal electrical connection.

Moreover, the mutually facing surfaces of the ball and socket members may be provided with appropriate guide means, whereby the ball member may be prevented from rotating about the longitudinal axis of the device.

Other objects, features and advantages of this invention will become apparent from the following description which should be read with reference to the accompanying drawings, in which.

Figure 8:
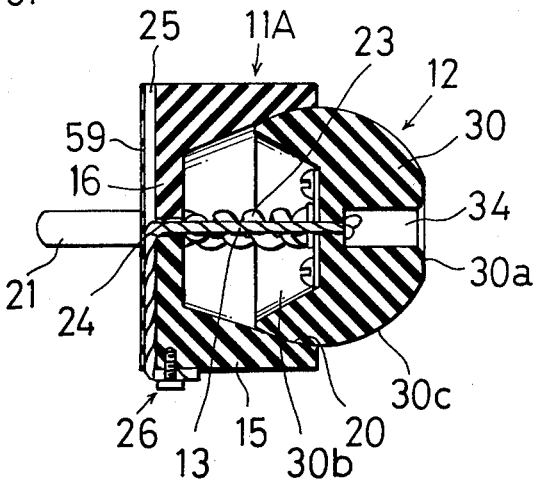
FIG. 8 is a longitudinal sectional view of the device shown in FIG. 7 and taken along the line VIII—VIII thereof.

Referring now to the drawings more particularly, especially FIGS. 1 through 5 thereof, there is shown a plug receptacle 10 which comprises a socket member 11 and a ball member 12 rotatably supported on the socket member 11 by a string 13. The socket member 11 includes a sleeve 15 and an insulating base 16 provided at one end of the sleeve 15 and closing that end of the sleeve 15. The insulating base 16 has an outer periphery formed with a flange 17. The sleeve 15 and the insulating base 16 are of integral construction formed from a hard insulative material. A flush plate 18 is secured to the rear face of the insulating base 16 by screws 19 extending through the flange 17. The flush plate 18 is adapted to cover the front opening of an outlet box embedded in a wall of a room or the like. The flange 17 and the screws 19 are, however, only illustrative of means for connecting the insulating base 16 to the flush plate 18 and it is alternatively possible to use an appropriate adhesive for the purpose of such connection as shown in FIG. 8, in which a layer of adhesive material 59 is formed on the rear face of the insulating base 16. The screws 19 also serve to secure the socket member 11 to the outlet box. The sleeve 15 has another end that is open and formed with a flared bearing surface 20 having an annular shape. The bearing surface 20 has a spherical configuration, so that the ball member 12 can slidably fit the bearing surface 20 as will hereinafter be described in further detail. The sphere which defines the spherical configuration of the bearing surface 20 has its center on the center of the open end of the sleeve 15 or slightly outwardly thereof.

Figure 2:
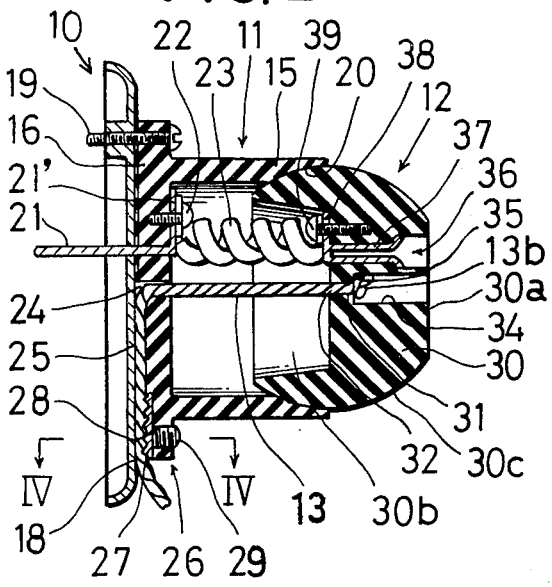
FIG. 2 is a sectional view taken along the line II—II of FIG. 1.

A pair of contact blades 21 are secured to the insulating base 16 and project beyond the rear face of the flush plate 18. The contact blades 21 are adapted to be received in an existing socket in the outlet box. The contact blades 21 are made of a metallic material having a good electrical conductivity. The contact blades 21 are spaced from each other to suit the spacing between the outlet openings of the existing socket. Each of the contact blades 21 has an inner end 21' located within the sleeve 15 and bent at right angles to the remaining portion of the contact blade 21. One end of an electric wire 23 is fastened to the bent end 21' of each contact blade 21 by a screw 22 as shown in FIG. 2. It is, however, to be noted that any other means than the screws 22 may equally be used to connect the electric wires 23 to the contact blades 21. The electric wires 23 are covered wires and coiled for expansion. Each of the screws 22 does not merely connect the electric wire 23 to the bent end 21' of the contact blade 21, but also serves to fasten the bent end 21' of the contact blade 21 to the insulating base 16 as is obvious from FIG. 2.

An aperture 24 is provided through the center of the insulating base 16 and a groove 25 connected with the aperture 24 is formed in the rear face of the insulating base 16. The aperture 24 and the groove 25 represent in combination an example of means for guiding the string 13 extending from the interior to the exterior of the socket member 11. The string 13 merely represents an example of means for connecting the ball member 12 to the socket member 11. In the embodiment of FIGS. 1 to 5, a nylon string having a diameter of approximately 1 to 1.5 mm is used, but it is alternatively possible to use a chain, a wire rope or any other type of string which is rigid and flexible.

The insulating base 16 is provided with means for clamping the string 13 thereto. The clamping means 26 comprises a clamping plate 27 positioned in the groove 25. The clamping plate 27 has an uneven surface facing the string 13 and adapted for frictional contact therewith. The insulating base 16 includes a threaded bore 28 in which a set screw 29 is engaged for rotation in one direction to hold the string 13 against the flush plate 18. The string 13 includes a string extension **13*a* projecting out of the groove 25. The string extension 13*a* may conveniently be wound round the socket member 11 as shown in FIG. 1** and fastened to it by any appropriate fastening means.

The ball member 12 comprises a generally spherical, partly hollow body 30 and a number of parts provided in the body 30. The body 30 may be formed from an appropriate electrically insulative material which may be selected, for example, from among synthetic resins. The body 30 has a flat front surface **30*a*, a concave rear surface 30*b* and a spherical outer peripheral surface 30*c*. The outer peripheral surrface 30*c* has a radius which is greater than the minimum radius of the bearing surface 20 of the sleeve 15, but which is equal to the radius of the sphere defining the bearing surface 20, so that the outer peripheral surface 30*c* closely fits the bearing surface 20. The body 30 is provided approximately in its center with a through hole 31 through which the string 13 extends. The open end of the hole 31 which is closer to the rear surface 30*b* is located on the center 32 of the sphere defining the outer peripheral surface 30*c*. The other end of the hole 31 is connected with another through hole 34 which is greater in diameter than the hole 31. The difference in diameter between the holes 31 and 34 defines an annular shoulder 35 therebetween. The string 13 includes a knot 13*b* formed at its end remote from the string extension 13*a* and the knot 13*b* bears against the shoulder 35.**

Figure 1:
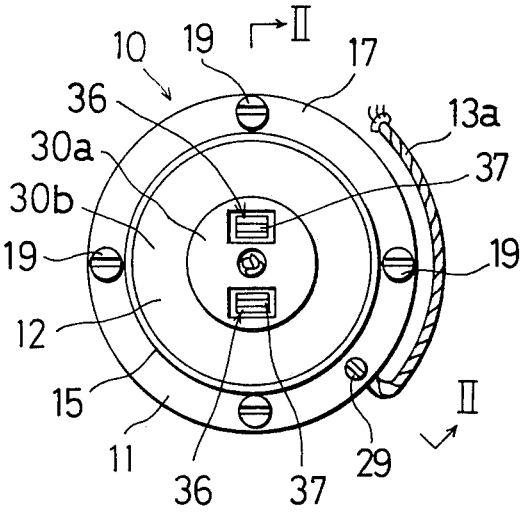
FIG. 1 is a front elevational view of the plug receptacle embodying this invention.

A pair of openings 36 are juxtaposed in the front surface **30*a* of the body 30 as shown in FIG. 1. Each opening 36 contains a female receptacle 37 which is adapted in a well known manner to receive therein one of contact pins or poles, not shown, of a plug 40 to establish both mechanical and electrical connection. Each of the female receptacles 37 has a base end portion 38 which is exposed on the rear surface 30*b* of the body 30 and bent at right angles to the remaining portion of the receptacle 37. The other end of each electric wire 23 is fastened to the base end portion 38 of one of the female receptacles 37 by an appropriate means, for example, a screw 39. The female receptacles 37 are made of an appropriate metallic material having a good electrical conductivity. The screws 39 do not merely fasten the electric wires 23 to the base end portions 38 of the female receptacles 37, but also serve to connect the base end portions 38 to the body 30 of the ball member 12.**

Figure 3:
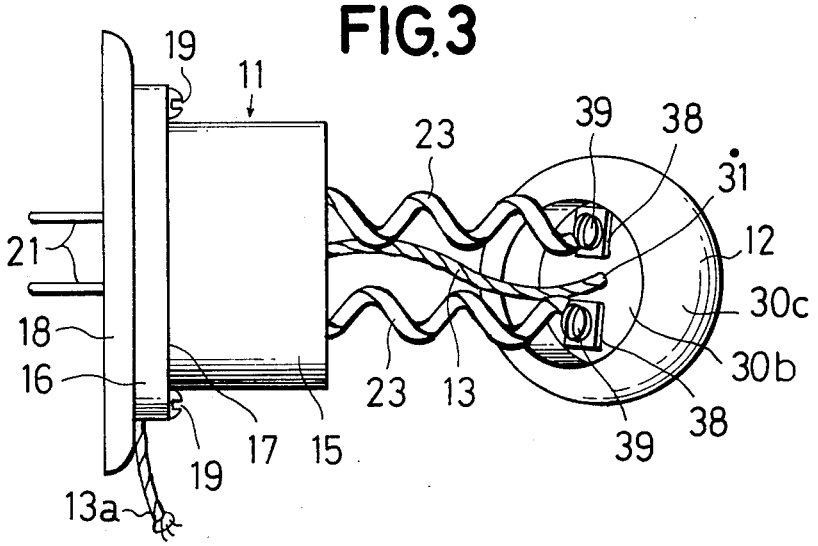
FIG. 3 is a side elevational view showing the ball member detached from the socket member.
Figure 4:
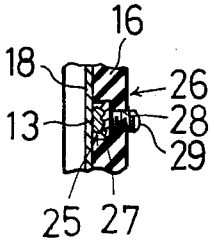
FIG. 4 is a sectional view taken along the line IV—IV of FIG. 2.

Attention is now directed to a method of positioning the ball member 12 correctly relative to the socket member 11. FIG. 3 shows the socket member 11 and the ball member 12 in their separated or disassembled position. The string extension **13*a* is pulled outwardly along the groove 25 to draw the ball member 12 toward the socket member 11, whereby the outer peripheral surface 30*c* of the body 30 abuts on the bearing surface 20 of the sleeve 15. If too large a force is applied to pull out the string 13, the outer peripheral surface 30*c* is brought into an undesirable frictional contact with the bearing surface 20 due to an excessive tension exerted on the string 13 to prevent the ball member 12 from rotating smoothly relative to the socket member 11. In order to allow the ball member 12 to rotate on the bearing surface 20 smoothly as necessary, the tension exerted on the string 13 must be appropriately adjusted to provide an adequate friction between the bearing surface 20 of the socket member 11 and the outer peripheral surface 30*c* of the ball member 12. When this condition is satisfied, the set screw 29 is tightened to hold the string 13 against the flush plate 18. The electric wires 23 contract and house themselves in the socket member 11 as shown in FIG. 2.**

Figure 5:
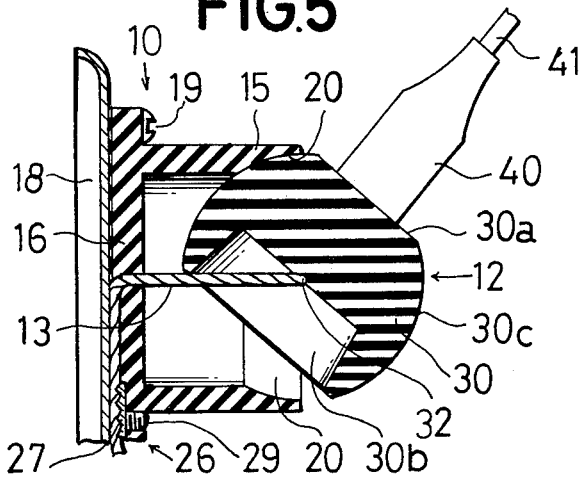
FIG. 5 is a longitudinal sectional view showing angular displacement of the ball member relative to the socket member.

FIG. 5 is intended for illustrating a mode of operation of the plug receptacle 10 as hereinabove described. When a cord 41 to which the plug 40 is attached is pulled in an upward direction, the plug 40 is also pulled in the same direction. Consequently, the ball member 12 is smoothly rotated upward on the bearing surface 20 about the sphere center 32. In this way, the openings 36 of the ball member 12 are always directed in a direction in which the cord 41 is pulled, whereby the contact pins or poles of the plug 40 are always pulled out from the openings 36 exactly along the longitudinal axes of the openings 36.

Figure 6:
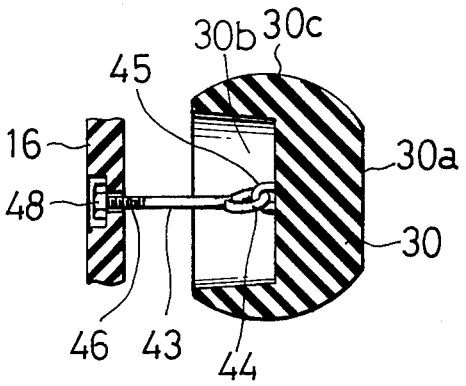
FIG. 6 is a fragmentary longitudinal sectional view illustrating a different connecting member from that shown in FIGS. 1 through 5.

FIG. 6 illustrates a modified form of the connecting member shown in FIG. 2. Like numerals are used to indicate like parts or elements throughout the views of FIGS. 2 and 6. The connecting member employed in the device of FIG. 6 comprises a metal rod 43 having a hooked portion 44 at one end. The hooked portion 44 is removably engaged with a U-shaped retaining member 45 placed in the concave surface of the ball member body 30. The other end of the metal rod 43 is externally threaded as indicated at 46. The externally threaded portion 46 extends outward through an aperture in the insulating base 16 and is held against the rear face of the insulating base 16 by a nut 48. Thus, the insulating base 16 and the ball member body 30 can be easily separated from each other simply by removing the nut 48 from the metal rod 43. As is obvious from FIG. 6, the ball member is freely rotatable about the hooked portion 44 of the metal rod 43.

Figure 7:
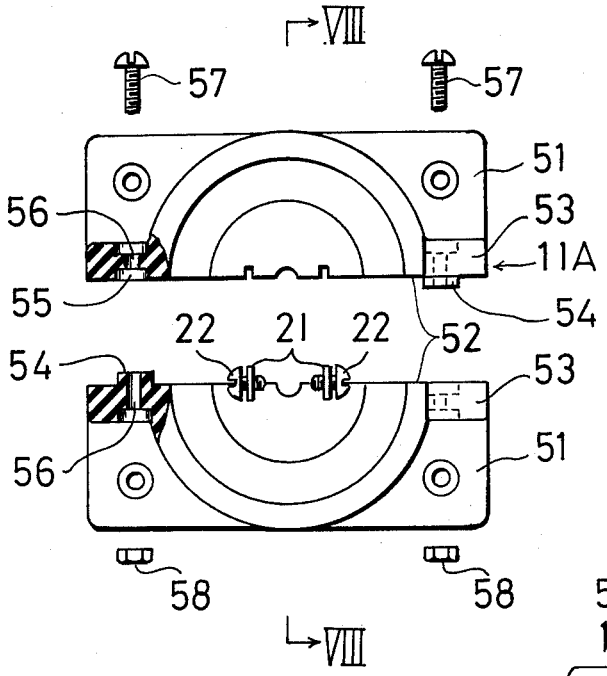
FIG. 7 is a fragmentary front elevational view showing another embodiment of this invention.

Reference is now made to FIGS. 7 and 8 showing another embodiment of this invention. The device of FIGS. 7 and 8 comprises a socket member 11A of the split construction which is separable into a pair of like elements 51 in a plane containing the longitudinal axis of the socket member. Each element 51 includes a mating face 52 which coincides with the plane in which the longitudinal axis of the socket member 11A extends. Each element 51 is formed with a dowel 54 in the vicinity of one edge of the mating face 52 and a complementary hollow 55 near the opposite edge. When the elements 51 are mated with each other, the dowel 54 of one element 51 fits into the hollow 55 of the other element 51, whereby the two elements 51 are kept from displacement relative to each other in the plane in which they are mated. Each element 51 is provided with lugs 53 adjacent to the mating surface and the lug 53 has a through hole 56 having a longitudinal axis perpendicular to the mating surface. When the two elements 51 are put together, they are integrally connected by screws 57 extending through the holes 56 of the lugs 53 and nuts 58 inserted over the screws 57. The two elements 51 are of identical shape and can be molded in a single die.

Figure 9:
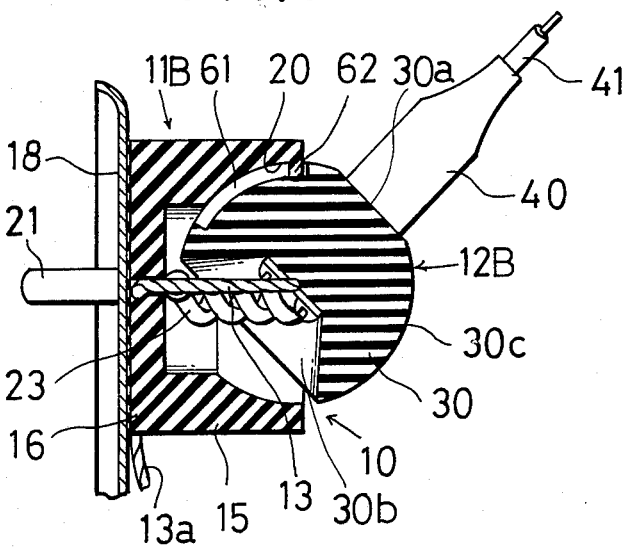
FIG. 9 is a longitudinal sectional view of a further embodiment of this invention.

FIG. 9 illustrates a further embodiment of this invention. The device of FIG,. 9 comprises a ball member 12B having a spherical outer peripheral surface **30*c* which is formed with an elongate groove 61 running along a plane containing the longitudinal axis of the ball member, i.e., the line connecting the centers of the front and rear surfaces 30*a* and 30*b*. This plane is a vertical plane when the device is in use. A pin 62 projects from the bearing surface 20 of a socket member 11B and is engaged in the elongate groove 61 of the ball member. The groove 61 and the pin 62 constitute in combination guide means for preventing rotation of the ball member 12B about the aforementioned longitudinal axis thereof, while permitting free rotation of the ball member relative to the socket member 11B in any direction as desired, whether vertically, horizontally or obliquely. It will be understood that the elongate groove 61 may alternatively be formed to extend along any other plane if that plane contains the aforementioned longitudinal axis of the ball member. It will further be observed that the guide pin 62 may be formed to project from any other portion of the bearing surface of the socket member 11B if it is positioned to fit in the elongate groove 61**.

Although the invention has been described with reference to several embodiments thereof, it is to be understood that further modifications or variations may be made by any person of ordinary skill in the art without departing from the scope of this invention which is defined by the appended claims.

What is claimed is:

1. A plug receptacle comprising:

a socket member adapted for connection with an outlet in a wall of a room or the like and having an open end;

a ball member bearing on said open end of said socket member;

means for connecting said ball member to said socket member to hold said ball member in bearing relation to said socket member;

said socket member comprising:

a sleeve having one end formed with a flared bearing surface encircling said open end of said socket member, said sleeve having an internal radius defining a minimum radius of said bearing surface;

an insulating base provided at another end of said sleeve;

means provided on said insulating base for fastening said socket member to said wall outlet; and contact blades projecting from said insulating base and adapted for insertion into said wall outlet;

said ball member comprising:

a body including a generally flat front surface; a concavely shaped rear surface generally facing said insulating base; and a spherically shaped outer peripheral surface extending between said front and rear surfaces and having a radius which is greater than said minimum radius of said bearing surface of said sleeve;

openings formed through said body and open at said front surface;

connectors provided on said rear surface and connected to said contact blades by conductors; and female receptacles each placed in one of said openings and connected to one of said connectors;

said connecting means having one end releasably fastened to said insulating base and another end flexibly connected to said rear surface of said ball member body, whereby said outer peripheral surface of said ball member is slidably held in contact with said bearing surface of said socket member.

2. The plug receptacle as defined in claim 1, wherein said means for fastening said socket member to said wall outlet comprises an adhesive laid on one surface of said insulating base.

3. The plug receptacle as defined in claim 1, wherein said connecting means comprises a flexible string having one end fastened to said ball member body and extending outwardly of said socket member through said insulating base, wherein said insulating base includes guide means supporting said string between said one end thereof and another end thereof, wherein said string has a length which is sufficient to permit said other end of said string to remain exposed outwardly of said socket member when said ball member is separated from said socket member to thereby move said one end of sid string away from said socket member, and wherein said guide means is provided with means for clamping said string intermediate said ends thereof when said ball member is held in said slidable contact with said said socket member.

4. The plug receptacle as defined in claim 1, wherein said other end of said connecting means is connected to that portion of said rear surface of said ball member body which coincides with the center of a sphere defining said spherical outer peripheral surface of said ball member body.

5. The plug receptacle as defined in claim 1, wherein said connecting means comprises a member made of a hard material.

6. The plug receptacle as defined in claim 1, further including a flush plate adapted to cover said wall outlet and carrying said means for fastening said socket member to said wall outlet.

7. The plug receptacle as defined in claim 1, wherein said outer peripheral surface of said ball member body is formed with an elongate groove extending in a plane containing a line connecting the centerof said front surface and the center of said rear surface, and wherein said bearing surface of said socket member is formed with a projection received in said elongate groove.

8. The plug receptacle as defined in claim 1, wherein said socket member comprises a plurality of elements having an identical shape and size and separable from one another in a plane containing the longitudinal axis of said sleeve.

9. The plug receptacle as defined in claim 1, wherein each of said conductors comprises an expandably coiled electric wire.

10. The plug receptacle as defined in claim 5, wherein said connecting member comprises a metal rod having a hooked portion at one end, wherein a U-shaped retaining member projects from said rear surface of said ball member body to removably retain said hooked portion, wherein said metal rod has another end releasably held against said insulating base by a nut.

11. The plug receptacle as defined in claim 6, wherein said means for fastening said socket member to said wall outlet comprises a flange radially outwardly extending from said insulating base and a plurality of screws extending through said flange and said flush plate to be received in said wall.

12. The plug receptacle as defined in claim 3, wherein said guide means comprises a groove formed in the surface of said insulating base remote from said sleeve, wherein said clamping means comprises a clamping plate placed in said groove and having an outwardly facing uneven surface adapted for frictional contact with said string and a set screw carried by said insulating base and adapted for abutment upon rotation in one direction against said clamping plate to urge said uneven surface into said frictional contact with said string, wherein a planar member is removably secured to said surface of said insulating base and cooperates with said clamping plate to hold said string unmovably upon said rotation of said set screw.

* * * * *